United States Patent [19]

Rumsey

[11] Patent Number: 4,942,710

[45] Date of Patent: Jul. 24, 1990

[54] FIRE-RATED EXPANSION JOINT HAVING THREE DEGREES OF FREEDOM

[75] Inventor: Roger L. Rumsey, Wichita, Kans.

[73] Assignee: Balco International, Inc., Wichita, Kans.

[21] Appl. No.: 453,095

[22] Filed: Dec. 13, 1989

Related U.S. Application Data

[63] Continuation of Ser. No. 190,289, May 6, 1988, abandoned.

[51] Int. Cl.[5] ..... E04B 1/56

[52] U.S. Cl. ..... 52/396; 52/464; 52/468; 52/573; 404/68

[58] Field of Search ..... 52/13, 15, 395, 396, 52/461, 464, 466, 468, 573, 317; 404/2, 47, 68

[56] References Cited

U.S. PATENT DOCUMENTS

| | | | |
|---|---|---|---|
| 3,300,913 | 1/1967 | Patry et al. | 52/573 X |
| 3,375,621 | 4/1968 | Curtis et al. | 52/395 X |
| 3,394,639 | 7/1968 | Viehmann | 52/395 X |
| 3,447,430 | 6/1969 | Gausepohl | 52/395 X |
| 4,359,847 | 11/1982 | Schukolinski | 52/396 |
| 4,663,894 | 5/1987 | LaRoche et al. | 52/15 |
| 4,706,426 | 11/1987 | Rumsey | 52/232 |

FOREIGN PATENT DOCUMENTS

| | | | |
|---|---|---|---|
| 3412515 | 11/1985 | Fed. Rep. of Germany | 52/396 |

*Primary Examiner*—David A. Scherbel
*Assistant Examiner*—Caroline D. Dennison
*Attorney, Agent, or Firm*—Hovey, Williams, Timmons & Collins

[57] ABSTRACT

An expansion joint assembly for use between elongated, adjacent, relatively shiftable, joint-defining structural sections (e.g., floor sections) is provided which exhibits three degrees of freedom for accommodating essentially all relative movement of structural members. The preferred assembly is fire-rated and includes a pair of elongated metallic supports adapted for fixed attachment to a corresponding structural section adjacent an expansion joint, together with an elongated, flexible, U-shaped bridging member. Connection between the bridging member and the supports is provided by means of interfitted, longitudinally shiftable U-shaped elements respectively secured to the supports and the adjacent edges of the bridging member. The metallic supports preferably include abutment structure overlying a corresponding interfitted pair of connection elements, in order to maintain the elements in their proper orientation, even in the event of vertical shifting of the structural sections.

8 Claims, 2 Drawing Sheets

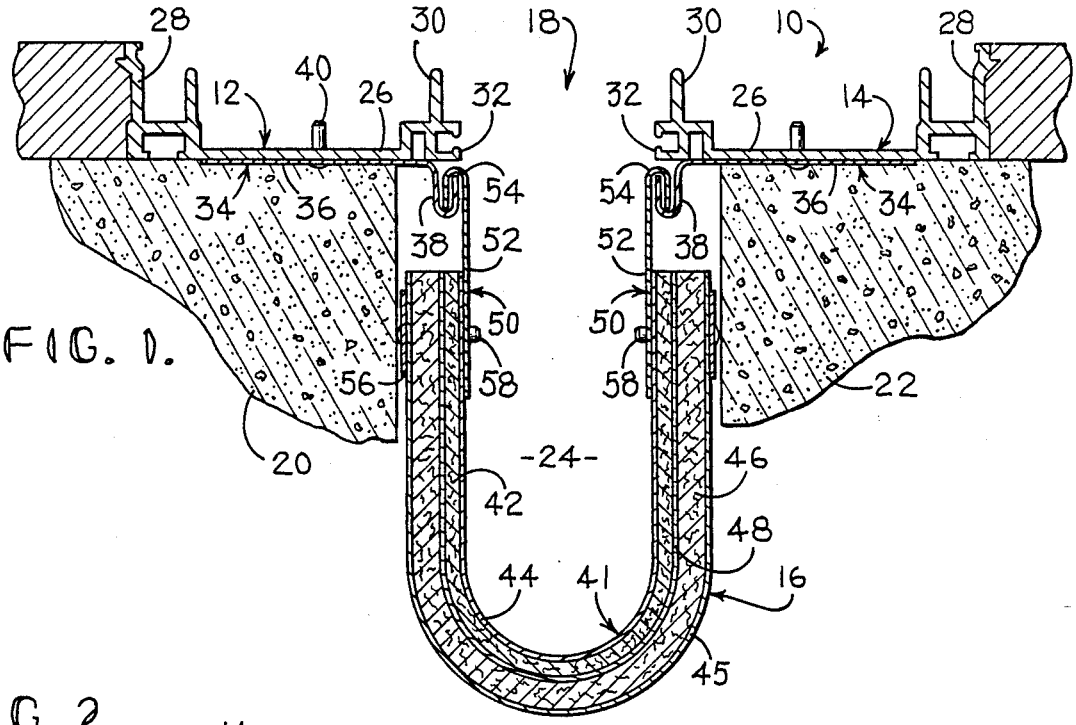
FIG. 1.
FIG. 2.
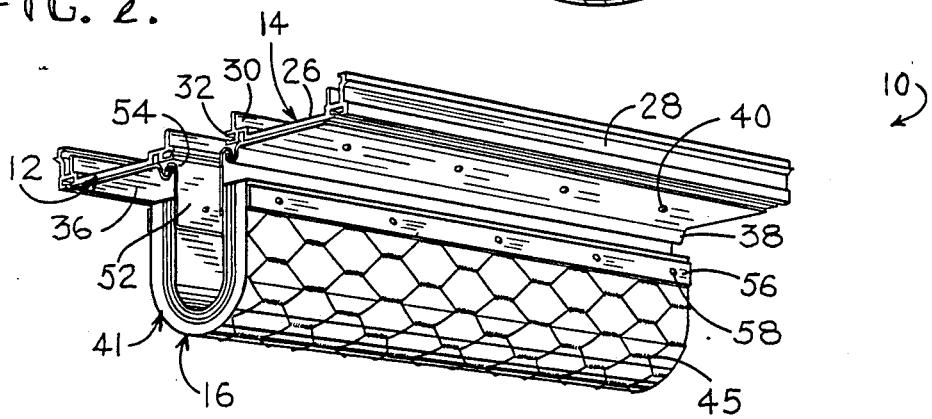
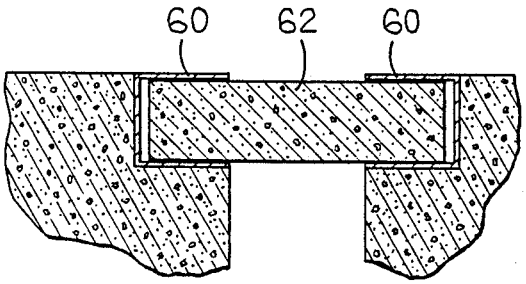
FIG. 5.
PRIOR ART
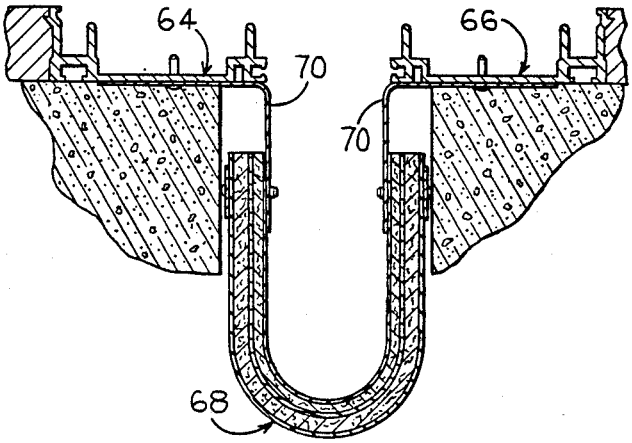
FIG. 6.
PRIOR ART

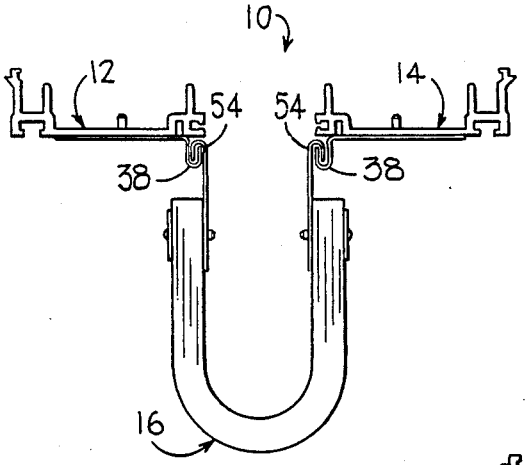
FIG. 3a
FIG. 3b.
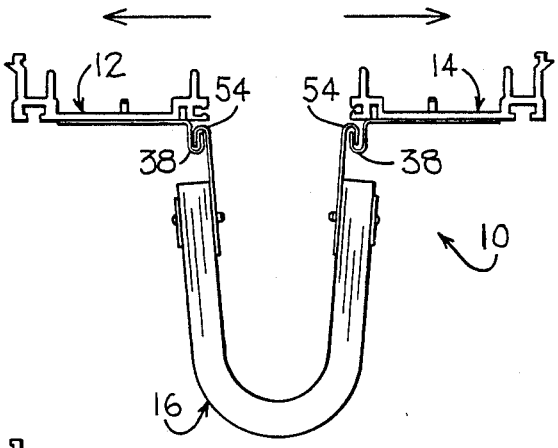
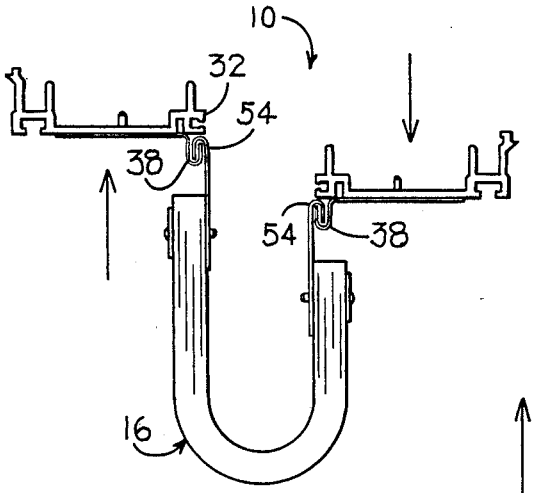
FIG. 3c.
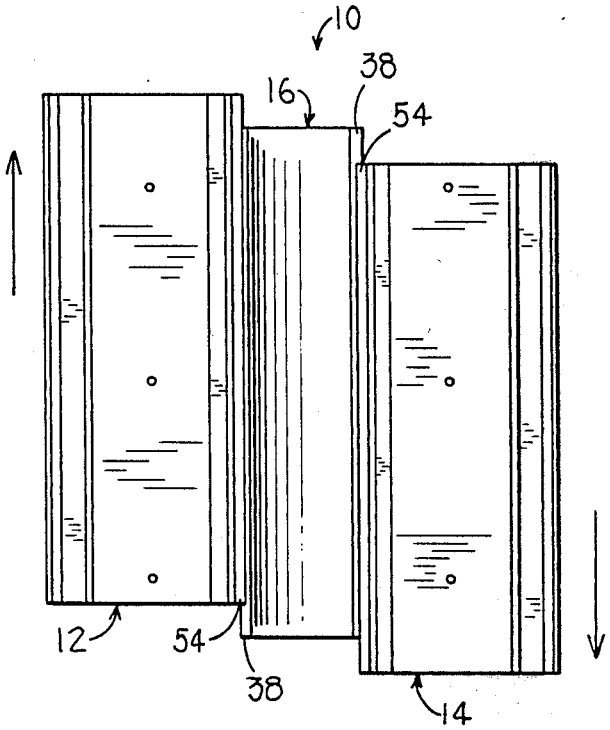
FIG. 4.

FIRE-RATED EXPANSION JOINT HAVING THREE DEGREES OF FREEDOM

This is a continuation of copending application Ser. No. 190,289 filed on 5/6/88 abandoned.

BACKGROUND OF THE INVENTION

1. Field of the Invention

The present invention is broadly concerned with an expansion joint structure particularly useful in the context of floor expansion joints and which exhibits three degrees of freedom in order to accommodate virtually all relative movement between adjacent structural sections. More particularly, it is concerned with such an expansion joint which is preferably constructed to be fire-rated and which maintains its fire rating even upon relatively significant movement between adjacent structural sections which has been known to destroy the integrity of prior fire-rated designs.

2. Description of the Prior Art

Expansion joints have long been used in floors and walls of buildings in order to accommodate normal relative shifting movement occurring by virtue of settling or thermal cycling. In the case of floor expansion joints, such have included a pair of extruded aluminum supports fixed to adjacent joint-defining floor sections together with a cover in overlying relationship to the joint and operably affixed to the supports to maintain its covering relationship even during normal movement of the floor sections.

In recent years, architects have increasingly demanded that expansion joints be fire-rated, at least to the rating of the adjacent walls or floor sections. Thus, U.S. Pat. No. 4,706,426 describes an innovative fire-rated flush mounted corner guard designed to give fully adequate fire rating at least up to the level of the adjacent walls.

It has also been known in the past to provide fire-rated floor expansion joints. Such units have typically included a generally U-shaped in cross-section bridging member between adjacent floor sections and constructed of fire-resistant material. A problem with such prior joints, however, is that they are unable to accommodate three degrees of relative movement of the floor sections while still retaining their fire rating. Thus, in such designs, where the floor sections shift longitudinally relative to each other, the U-shaped bridging member tends to tear or detach, thus impairing its fire rating.

Another type of floor expansion joint heretofore proposed comprises a pair of U-shaped metallic supports affixed to each floor section at the joint area and facing each other; a concrete pad or treadway is received by the facing U-shaped supports. This type of construction can accommodate longitudinal shifting of the floor sections, and also movement of such sections towards and away from each other. However, it cannot properly accommodate relative vertical shifting of the floor sections.

Accordingly, there is a decided need in the art for an improved expansion joint structure which exhibits three degrees of freedom and which, if desired, can be constructed of fire-rated materials. In this fashion, the joint structure can maintain its original fire rating notwithstanding relatively significant movement of the joint-defining structural sections.

SUMMARY OF THE INVENTION

The present invention overcomes the problems noted above and provides a greatly improved expansion joint for use between a pair of elongated, adjacent, relatively shiftable structural sections presenting therebetween an expansion void of a given nominal width. The joint exhibits three degrees of freedom for accommodating virtually all relative movement of the structural members, and is advantageously formed of fire-rated materials such as flexible ceramic-based insulation.

In preferred forms, the expansion joint of the invention includes a pair of elongated supports (typically formed of extruded aluminum) adapted for fixed attachment to a corresponding structural section adjacent an expansion void. The joint also includes an elongated, flexible bridging member having a width greater than the nominal width of the expansion void, with the bridging member being situated within the void and beneath the supports. The flexible bridging member is operatively coupled to the supports in a manner for: relative longitudinal shifting movement between the bridging member and one or both of the structural sections in the event of relative longitudinal shifting movement of the latter; compression and stretching of the flexible bridging member upon movement of the structural sections towards and away from each other; and vertical movement of at least a portion of the flexible bridging member in the event of relative vertical movement of the structural sections.

In order to provide the desired coupling between the flexible bridging member and the adjacent section-mounted supports, it is preferred to provide a pair of metallic, shiftably interfitted, elongated, U-shaped elements respectively coupling each side edge of the flexible member and the adjacent supports. One of these elements is secured to the corresponding support, while the other element is attached to the adjacent edge of the flexible member. In this fashion, upon longitudinal shifting of the structural sections, a relative sliding movement occurs between the interfitted U-shaped elements of the supports and bridging member edges, so that such movement is accommodated without tearing or undue stress being imposed upon the bridging member.

Where it is desired to produce a fire-rated expansion joint in accordance with the invention, the flexible bridging member is preferably composed of a pair of sheets of ceramic thermal insulative material, together with a supporting medium such as chicken wire. Such a fire-rated bridging member would typically present a U-shaped cross-section, and extend the full length of the joint in question.

BRIEF DESCRIPTION OF THE DRAWINGS

FIG. 1 is a cross-sectional view of the preferred fire-rated expansion joint in accordance with the invention, shown operatively attached and in spanning relationship between a pair of floor sections;

FIG. 2 is a perspective view of the expansion joint assembly illustrated in FIG. 1;

FIGS. 3*a*–3*c* are respectively schematic view of the expansion joint assembly depicted in FIGS. 1 and 2 with FIG. 3*a* showing the joint in its normal, installed condition, FIG. 3*b* illustrating the action of the joint assembly in accommodating movement of structural sections towards and away from each other, and FIG. 3*c* depicting the action of the joint assembly in accommodating relative vertical movement of structural sections;

FIG. 4 is a plan view of the joint assembly of FIGS. 1–2 showing the action of the assembly in accommodating longitudinal shifting movement of structural sections;

FIG. 5 is a cross-sectional view illustrating a prior expansion joint structure making use of a concrete pad or treadway; and FIG. 6 is a cross-sectional view depicting another type of expansion joint structure making use of a fire-rated bridging section, but which does not exhibit three degrees of freedom.

DETAILED DESCRIPTION OF THE DRAWINGS

Turning now to the drawings, an expansion joint assembly 10 is illustrated in FIGS. 1 and 2 and broadly includes a pair of elongated, extruded aluminum supports 12, 14, together with an elongated, flexible bridging member 16. In the illustrated embodiment, the assembly 10 is situated in an expansion joint broadly referred to by the numeral 18 defined between a pair of elongated, adjacent floor sections 20, 22. It will be observed in this respect that the bridging member 16 is situated entirely within the expansion void 24 defined between the upright surfaces of the sections 20, 22.

In more detail, each support 12, 14 includes a generally planar bottom panel 26 together with an upright outermost wall 28 and an innermost upright standard 30, the latter including a generally C-shaped segment 32, the purpose of which will be explained hereinafter. In addition, each section 12, 14 includes an integral connection element 34 formed of thin metallic material and presenting a planar section 36 and an innermost, depending, upwardly opening U-shaped coupling section 38. The planar section 36 of each element 34 is affixed to the underside of the associated bottom panel 26 through the use of rivets 40. It will further be seen that the coupling sections 38 are directly below the C-shaped segments 32, and are within the confines of the void 24 between structural sections 20, 22.

The bridging member 16 is in the form of an elongated, multiple ply, fire-rated body 41 including an uppermost ceramic mat 42 formed from carborundum fibers and presenting an upper reflective foil facing 44. This product is commercially available and is commercialized under the designation 970-A by the Carborundum Company of Buffalo, N.Y. The member 41 further includes a lower, somewhat thicker insulative section in the form of an intumescent ceramic fiber mat 46 having an uppermost reflective foil facing 48. Such a product is sold by the 3M Company of Minneapolis, Minn. under the designation "I-10A", and has the property of expanding under the influence of high temperatures in order to assist in sealing a joint and assuring the fire rating thereof. Finally, the body 41 inc a lowermost support in the form of chicken wire 45. As can be seen, the mats 42, 44 are positioned in face-to-face relationship and cooperatively define the depending, cross-sectionally U-shaped configuration of the body 41.

The overall bridging member 16 includes a pair of upper connection elements 50 respectively secured to the upper edges of body 41 as illustrated. The elements 50 are in the form of integral, thin metallic sheets presenting an upstanding planar portion 52 and an uppermost, U-shaped in cross-section, downwardly opening coupling section 54. The respective connection elements 50 are secured to the upper, inner edges of body 41 by means of an outer metallic sandwich strip 56 disposed in opposed relationship to each planar portion 52, together with a series of spaced rivets 58. Referring particularly to FIG. 1, it will be seen that the upper end margins of the body 41 are sandwiched between the associated planar portions 52, and the cooperating sandwich strips 56.

It will be observed that coupling of the bridging member 16 to the supports 12 is effected by means of interfitting between the U-shaped sections 54, 38. In this fashion, the assembly 10 can accommodate relative longitudinal shifting movement of the floor sections 20, 22, i.e., the floor sections can freely shift relative to the bridging member 16. Furthermore, it will be seen that the lower surfaces of the C-shaped segments 32 act to maintain the interfitted U-shaped sections 54, 38 in their operative disposition, even upon relative vertical shifting movement of the floor sections.

The described bridging member 16 preferably has a fire rating sufficient to meet the dictates of ASTM Test E-119. Generally speaking, this standard requires that a wall or a floor exposed to a flame at 1800° F. for two hours will not allow a temperature rise above ambient of more than 250° F. on the opposite side of the wall or floor. Moreover, upon conclusion of such a two-hour firing, the flame-exposed wall or floor will not pass water from a fire hose stream directed against the wall or floor. A bridging member formed of the materials previously described will assure that the joint assembly meets the E-119 standard.

While not shown in detail in the drawings, it will be appreciated that in practice a completed expansion joint assembly would include a metallic tread plate operatively coupled to the supports 12, 14. Such an upper tread plate is of course conventional, and the supports 12, 14 are especially configured so as to properly receive such a cover plate.

Attention is next directed to schematic FIGS. *3a–3c* and 4. FIG. *3a* illustrates the joint assembly 10 in its normal condition, i.e., as installed and prior to relative shifting movement between the structural sections. FIG. *3b* on the other hand illustrates the assembly 10 while accommodating movement of the structural sections towards and away from each other. That is to say, as the structural sections move away from each other, the bridging member 16 in effect stretches to accommodate the motion. Similarly, if the sections move towards each other, the member 16 is compressed sufficiently to safely take up the motion, all without destroying the integrity of the assembly. FIG. *3c* on the other hand depicts the assembly 10 as it accommodates relative vertical movement between adjacent structural sections. In this mode, at least a portion of the flexible member 16 moves upwardly with the upwardly moving structural section, again without tearing or destruction of the bridging member 16. Furthermore, the abutment structure presented by the C-shaped sections 32 assures that the interfitted U-shaped sections 54, 38 are maintained in their operative disposition, even during such vertical section movement.

Finally, FIG. 4 illustrates the action of assembly 10 in accommodating longitudinal shifting movement between the bridging member 16 and one or more of the structural sections (and hence the supports 12, 14 secured thereto). In this situation, the interfitted sections 54, 38 slide longitudinally relative to each other so as to accommodate the longitudinal section movement without twisting or tearing of the bridging member 16.

It will thus be appreciated that the joint assembly of the present invention exhibits three degrees of freedom for accommodating virtually all relative movement of joint-defining structural sections. This is to be contrasted with prior art designs such as illustrated in FIGS. 5 and 6. In FIG. 5, a pan type arrangement is illustrated which includes a pair of U-shaped metallic pans 60 respectively secured to opposed floor sections and receiving a preformed concrete pad or tread plate 62. This design is relatively expensive and difficult to fabricate, and moreover cannot effectively accommodate vertical shifting movement of the structural sections, as will be readily apparent from a study of FIG. 5. On the other hand, FIG. 6 depicts a prior design making use of metallic supports 64, 66 and an elongated, U-shaped in cross-section, fire-rated bridging member 68. In this case though, the bridging member 68 is affixed to the associated supports 64, 66 simply by means of thin metallic connectors 70 which do not provide any means for accommodating longitudinal movement of the structural sections. As will be readily apparent from FIG. 6, upon such longitudinal shifting movement, the bridging member 68 is immediately subjected to twisting and tearing forces which tend to destroy the bridging member 68 and thus the fire rating of the overall assembly.

I claim:

1. An expansion joint for use between a pair of elongated, adjacent, relatively shiftable structural sections presenting therebetween an expansion void having a nominal width, said joint exhibiting three degrees of freedom for accommodating virtually all relative movement of said structural members, said joint comprising:

a pair of elongated supports configured for fixed attachment to a respective structural section adjacent the expansion void;

an elongated, flexible, bridging member composed of a fire-rated material having a width greater than the nominal width of the void and presenting a pair of respective, longitudinal edges; and means coupling said bridging member with said supports in a void-spanning relationship therewith and in a manner allowing lateral shifting of said member in the event of relative lateral movement of said supports, and allowing vertical movement of at least a portion of said member in the event of relative vertical movement of said supports, said coupling means including a pair of shiftably interfitted, elongated, U-shaped elements respectively coupling at least one of said edges of the flexible member and the adjacent support, one of said elements being secured to said support, the other of the elements being secured to said member edge, each of said U-shaped elements presenting a pair of side walls with one side wall from each element lapping a side wall of the other element in a longitudinally slidable relationship in order to prevent longitudinal stress on said bridging member in the event of relative longitudinal movement of said support, said coupling means further supporting said bridging member in a depending relationship for disposition thereof downwardly from said structural sections so that said bridging member hangs between said supports.

2. The expansion joint of claim 1, said supports each comprising a metallic plate including structure for supporting a cover plate.

3. The expansion joint of claim 1, said bridging member being generally U-shaped in cross-sectional configuration.

4. The expansion joint of claim 1, said coupling means including means coupling each of said edges and a corresponding one of said supports in a respective longitudinally slidable relationship.

5. The expansion joint of claim 1, said fire-rated material including material able to withstand a flame at a predetermined temperature for a predetermined length of time on one side thereof while preventing a predetermined temperature rise above ambient on the opposed side thereof.

6. The expansion joint of claim 1, including means for retaining said elements in said interfitted condition.

7. The expansion joint of claim 6, said retaining means including abutment structure forming a part of each support and overlying a corresponding interfitted pair of elements.

8. The expansion joint of claim 1, said structural sections being floor sections.

* * * * *